US011445866B2

(12) United States Patent
Daniels

(10) Patent No.: US 11,445,866 B2
(45) Date of Patent: Sep. 20, 2022

(54) WALL MOUNT BAR ASSEMBLY

(71) Applicant: LIBERTY HARDWARE MFG. CORP., Winston-Salem, NC (US)

(72) Inventor: James Leroy Daniels, Stokesdale, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 0 days.

(21) Appl. No.: 17/206,677

(22) Filed: Mar. 19, 2021

(65) Prior Publication Data

US 2021/0204762 A1 Jul. 8, 2021

Related U.S. Application Data

(63) Continuation of application No. 16/678,413, filed on Nov. 8, 2019, now Pat. No. 11,006,786.

(51) Int. Cl.

| | |
|---|---|
| ***A47K 10/10*** | (2006.01) |
| *A47F 5/08* | (2006.01) |
| *A47K 10/04* | (2006.01) |

(52) U.S. Cl.

CPC ..... *A47K 10/10* (2013.01); *A47F 5/08* (2013.01); *A47K 10/04* (2013.01)

(58) Field of Classification Search

CPC ..... A47K 10/04; A47K 10/06; A47K 10/08; A47K 10/10; A47K 10/16; F16B 5/123; F16M 13/02; A47F 5/08

USPC ..... 211/6, 16, 88.04; 248/205.1, 309.1, 342, 248/682

See application file for complete search history.

(56) References Cited

U.S. PATENT DOCUMENTS

| | | | |
|---|---|---|---|
| 1,202,190 | A | 10/1916 | Kern |
| 1,276,463 | A | 8/1918 | Wells |
| 2,052,606 | A | 9/1936 | Comstock |
| 2,825,469 | A | 3/1958 | Watkins et al. |
| D259,753 | S | 7/1981 | Fleischmann et al. |
| 4,349,940 | A | 9/1982 | Fleischmann et al. |
| 4,979,713 | A | 12/1990 | Bell |
| 5,026,012 | A | 6/1991 | Wang |
| 5,071,099 | A | 12/1991 | Kuo |
| 5,186,427 | A | 2/1993 | Semchuck |
| 5,875,903 | A | 3/1999 | Chen |
| 6,113,045 | A | 9/2000 | Kuo |
| 6,199,808 | B1 | 3/2001 | Lin |
| 6,334,541 | B1 | 1/2002 | Chang |

(Continued)

FOREIGN PATENT DOCUMENTS

| | | |
|---|---|---|
| CN | 201719155 U | 1/2011 |
| CN | 205181209 U | 4/2016 |

(Continued)

*Primary Examiner* — Jonathan Liu
*Assistant Examiner* — Devin K Barnett
(74) *Attorney, Agent, or Firm* — Brooks Kushman P.C.; Lora Graentzdoerffer

(57) ABSTRACT

A wall mount towel bar assembly provides a wall mount bracket adapted to be mounted to a planar surface. A threaded shaft is supported upon the wall mount bracket for rotation relative to the wall mount bracket. A sleeve is in threaded engagement with the threaded shaft with a sleeve aperture formed therein. A bar is received for translation in the sleeve aperture. Rotation of the threaded shaft locks the bar in the sleeve to maintain a position of the bar within the sleeve.

18 Claims, 5 Drawing Sheets

(56) References Cited

U.S. PATENT DOCUMENTS

| | | | | |
|---|---|---|---|---|
| 6,334,597 | B1 | 1/2002 | Ming-Hsiao | |
| 6,364,264 | B1 | 4/2002 | Lai | |
| 6,371,423 | B1 | 4/2002 | Miller | |
| D472,417 | S | 4/2003 | Hunt | |
| 6,651,830 | B2 * | 11/2003 | Pan | A47K 10/10 211/105.1 |
| 6,796,442 | B1 * | 9/2004 | Wu | A47K 10/04 211/105.1 |
| D540,588 | S | 4/2007 | Hoernig | |
| D540,599 | S | 4/2007 | Krumpe et al. | |
| D544,269 | S | 6/2007 | Hoernig | |
| D576,437 | S | 9/2008 | Krumpe et al. | |
| 7,571,532 | B2 | 8/2009 | Zimmerman | |
| D600,961 | S | 9/2009 | Krumpe | |
| D606,792 | S | 12/2009 | Yoo | |
| 8,556,224 | B2 | 10/2013 | Kharchenko et al. | |
| 8,671,545 | B1 | 3/2014 | Zimmerman | |
| 8,950,600 | B2 | 2/2015 | Sisto | |
| 9,220,340 | B2 | 12/2015 | Kuo | |
| 9,351,572 | B2 | 5/2016 | Kuo | |
| 10,111,559 | B2 | 10/2018 | Edwards et al. | |
| 2001/0001197 | A1 * | 5/2001 | Ramsey | B25H 3/06 206/378 |
| 2002/0104946 | A1 | 8/2002 | Lai | |
| 2004/0160775 | A1 | 8/2004 | Goodlett et al. | |
| 2006/0175496 | A1 | 8/2006 | Lai | |
| 2009/0236299 | A1 | 9/2009 | Hall | |
| 2009/0242713 | A1 * | 10/2009 | Lowe | A47K 10/10 248/222.13 |
| 2010/0102011 | A1 | 4/2010 | Blum | |
| 2012/0145854 | A1 | 6/2012 | Smith | |
| 2014/0032447 | A1 | 1/2014 | Fisher | |
| 2014/0306079 | A1 | 10/2014 | Kuo | |
| 2017/0336020 | A1 | 11/2017 | Jones | |
| 2019/0006829 | A1 | 1/2019 | Daniels et al. | |

FOREIGN PATENT DOCUMENTS

| | | | |
|---|---|---|---|
| CN | 107334414 | A | 11/2017 |
| KR | 20110008876 | U | 9/2011 |

* cited by examiner

WALL MOUNT BAR ASSEMBLY

CROSS-REFERENCE TO RELATED APPLICATIONS

This application is a continuation of U.S. application Ser. No. 16/678,413 filed Nov. 8, 2019, now U.S. Pat. No. 11,006,786 B1.

TECHNICAL FIELD

Various embodiments relate to wall mount towel bar assemblies.

BACKGROUND

The prior art has offered various wall mount towel bar assemblies with posts mounted to a wall to space a towel bar from the wall to support a towel.

SUMMARY

According to at least one embodiment, a wall mount towel bar assembly provides a wall mount bracket adapted to be mounted to a planar surface. A threaded shaft is supported upon the wall mount bracket for rotation relative to the wall mount bracket. A sleeve is in threaded engagement with the threaded shaft with a sleeve aperture formed therein. A bar is received for translation in the sleeve aperture. Rotation of the threaded shaft locks the bar in the sleeve to maintain a position of the bar within the sleeve.

According to a further embodiment, fasteners are provided to affix the wall mount bracket to the planar surface. A collar is sized to attach to the wall mount bracket. The threaded shaft is pivotally connected to the collar.

According to an even further embodiment, a post is connected to the threaded shaft for rotation with the threaded shaft. The post is sized to enclose the threaded shaft from the collar to the sleeve.

According to an even further embodiment, the threaded shaft is externally threaded. The sleeve further provides a boss extending from the sleeve with a threaded aperture in threaded engagement with the threaded shaft.

According to an even further embodiment, the sleeve further provides a collar extending from the sleeve coaxial with the boss to enclose a distal end of the post.

According to another further embodiment, a through aperture is formed through the collar. The threaded shaft further provides a fastener head oriented between the collar and the wall mount bracket with the threaded shaft extending through the collar aperture.

According to an even further embodiment, a washer is oriented about the threaded shaft between the fastener head and the collar.

According to another further embodiment, the sleeve further provides a threaded aperture in cooperation with the threaded shaft and axially intersecting the sleeve aperture.

According to an even further embodiment, the threaded aperture in the sleeve is perpendicular to the sleeve aperture.

According to an even further embodiment, a brake aperture is formed in the sleeve axially aligned with the threaded aperture and intersecting the sleeve aperture so that rotation of the threaded aperture applies pressure from the threaded shaft upon the bar.

According to an even further embodiment, a brake is oriented in the brake aperture to distribute pressure from the threaded shaft to the bar.

According to an even further embodiment, the brake is formed from a polymeric material.

According to an even further embodiment, the brake is formed from nylon.

According to another further embodiment, a second wall mount bracket is adapted to be mounted to the planar surface. A second threaded shaft is supported upon the second wall mount bracket for rotation relative to the second wall mount bracket. A second sleeve is in threaded engagement with the threaded shaft with an aperture formed therein to receive the bar for translation in the second sleeve. Rotation of the second threaded shaft locks the bar in the second sleeve to maintain a position of the bar within the second sleeve.

According to another embodiment, a method of installing a towel bar assembly mounts a pair of brackets to a wall. A pair of collars are installed upon the pair of brackets. A bar is translated within a pair of sleeves that are supported upon the pair of collars to a selected position. A pair of posts is tightened between the pair of sleeves and the pair of collars to retain the selected position of the bar relative to the pair of sleeves.

According to another embodiment, a method of adjusting a towel bar assembly installs a towel bar assembly by mounting a pair of brackets to a wall. A pair of collars are installed upon the pair of brackets. A bar is translated within a pair of sleeves that are supported upon the pair of collars to a selected position. A pair of posts is tightened between the pair of sleeves and the pair of collars to retain the selected position of the bar relative to the pair of sleeves. The pair of posts are loosened. The bar is translated to another selected position. The pair of posts are tightened.

According to another embodiment, a wall mount bar assembly provides a pair of wall mount brackets, each adapted to be mounted to a planar surface. A pair of wall collars, are each sized to attach to one of the pair of wall mount brackets with a through aperture formed therethrough. A pair of externally threaded shafts, are each provided with a fastener head oriented between one of the pair of wall collars and one of the pair of wall mount brackets, and extend through the corresponding collar aperture to pivotally connect to the corresponding wall collar for rotation relative to the wall collar. A pair of sleeves, are each provided with an aperture formed therethrough. A pair of bosses, each extend from one of the pair of sleeves with a threaded aperture perpendicular to the sleeve aperture and in threaded engagement with one of the pair of externally threaded shafts. A pair of post collars, each extend from one of the pair of sleeves coaxial with one of the pair of bosses. A bar is received for translation in the aperture of each of the pair of sleeves. A pair of posts, are each connected to one of the pair of threaded shafts for rotation with the threaded shaft, with a distal end extending within one of the pair of post collars, to enclose the threaded shaft from the wall collar to the sleeve. Rotation of the post rotates the threaded shaft to lock the bar in the sleeve to maintain a position of the bar within the sleeve.

According to a further embodiment, a pair of washers, are each oriented about one of the pair of threaded shafts between the fastener head and the corresponding collar.

According to another further embodiment, a brake aperture is formed in each of the pair of sleeves axially aligned with the threaded aperture and intersecting the sleeve aperture so that rotation of the threaded aperture applies pressure from the threaded shaft upon the bar.

According to an even further embodiment, a pair of brakes, are each oriented in the brake aperture in one of the pair of sleeves to distribute pressure from the threaded shaft to the bar.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Conventional towel bar assemblies have a fixed center-to-center post location. When an end user is installing a towel bar assembly, the end user typically identifies suitable locations for installing the posts, which consequently determines the location of the towel bar. Various walls may have obstacles, such as tile, grout, electrical, plumbing, and the like, that may be avoided when installing the towel bar assembly. Additionally, when an end user replaces an existing towel bar assembly, the selection may be limited to towel bar assemblies that match the center-to-center post spacing of the prior towel bar assembly.

Figure 1:
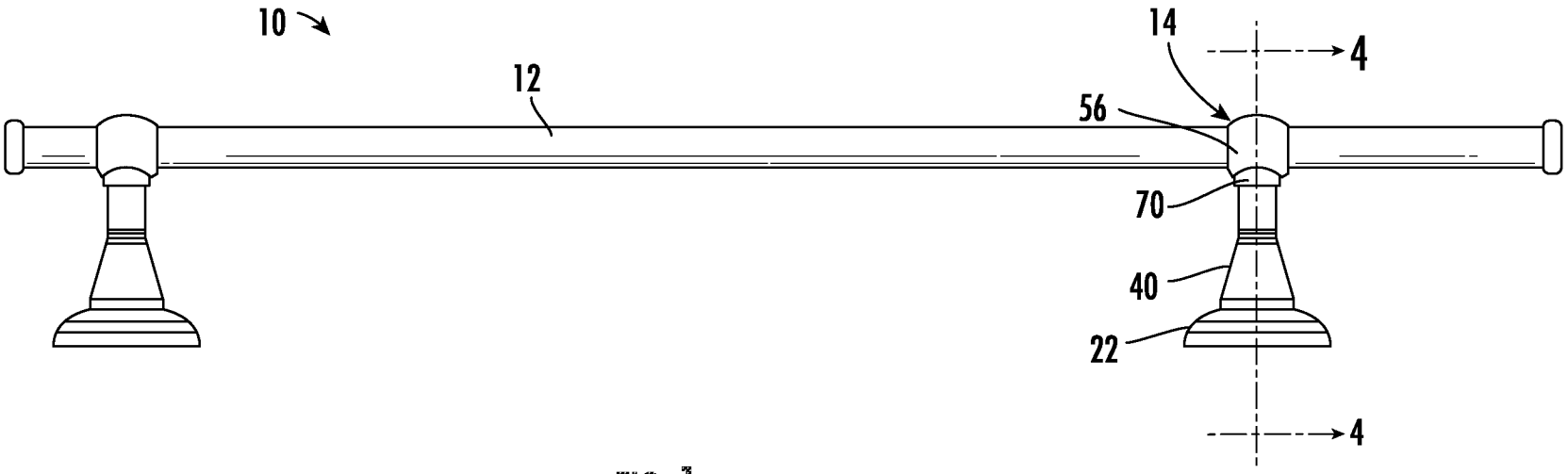
FIG. 1 is a top plan view of a towel bar assembly according to an embodiment.

FIG. 1 illustrates an adjustable towel bar assembly 10 according to an embodiment. The towel bar assembly 10 includes a towel bar 12 supported and extended from a wall by a plurality of post assemblies 14. The post assemblies 14 have a similar appearance to prior art post assemblies, however, the post assemblies 14 permit the towel bar 12 to be adjusted relative to the post assemblies 14. In other words, during installation, the end user can select a position for installation of the towel bar 12, and then select an installation position for each of the post assemblies 14. The adjustability of the post assemblies 14 permits the end user to adjust the linear position of the towel bar 12, and also adjust the center-to-center spacing of the post assemblies 14. Although two post assemblies 14 are illustrated and described, any number of post assemblies 14 may be employed.

Figure 2:
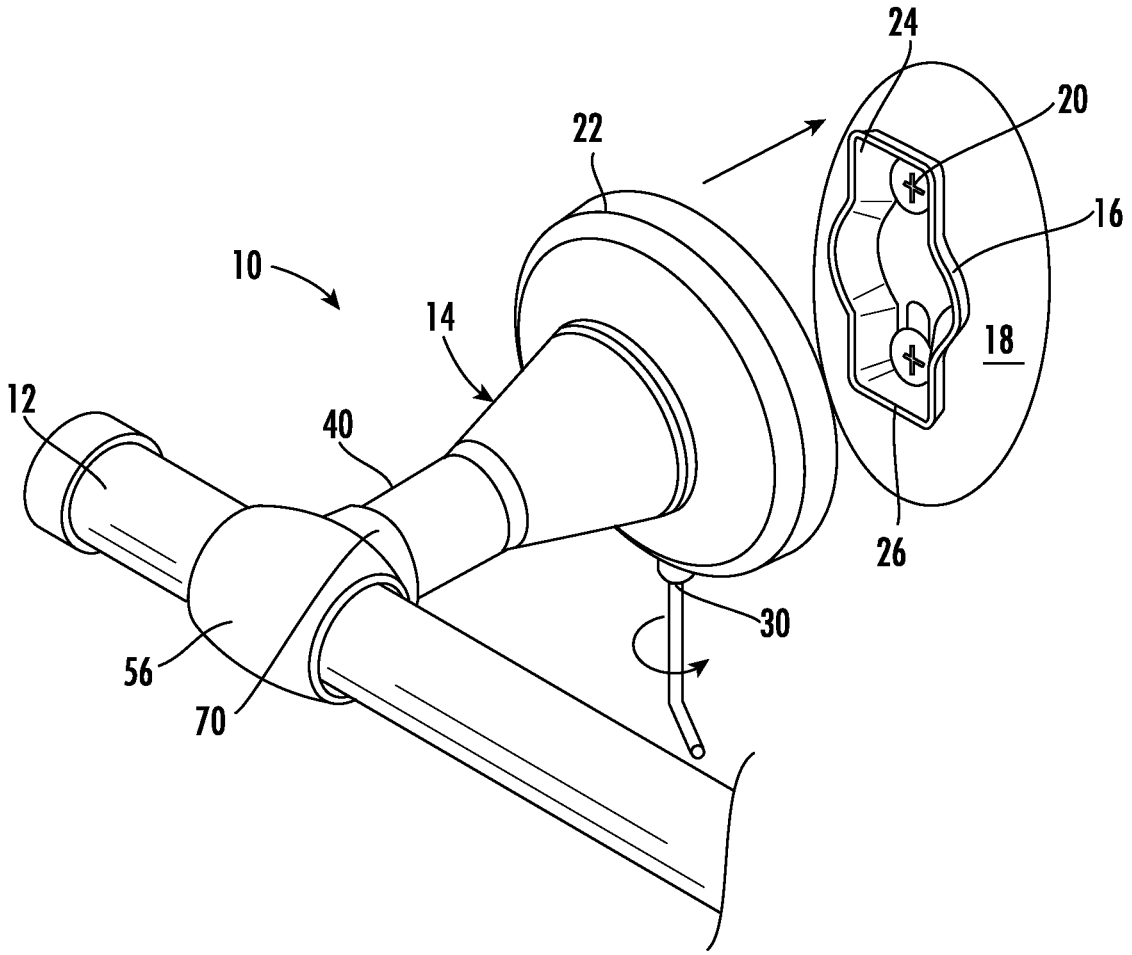
FIG. 2 is partial front exploded perspective view of a portion of the towel bar assembly of FIG. 1.

During installation, the post assemblies 14 may be loosened so that the post assemblies 14 are freely translatable along the towel bar. Referring to FIG. 2, the end user determines the mounting location of the towel bar 12, and each of the post assemblies 14. For the mounting location of each of the post assemblies 14, the end user installs a pair of wall mount brackets 16 to an upright planar support surface, such as a wall 18. The wall mount brackets 16 are fastened to the wall 18 by fasteners 20, which may be drywall anchors, wood screws or the like, as determined in the particular application and the structural support characteristics of the wall 18.

Figure 4:
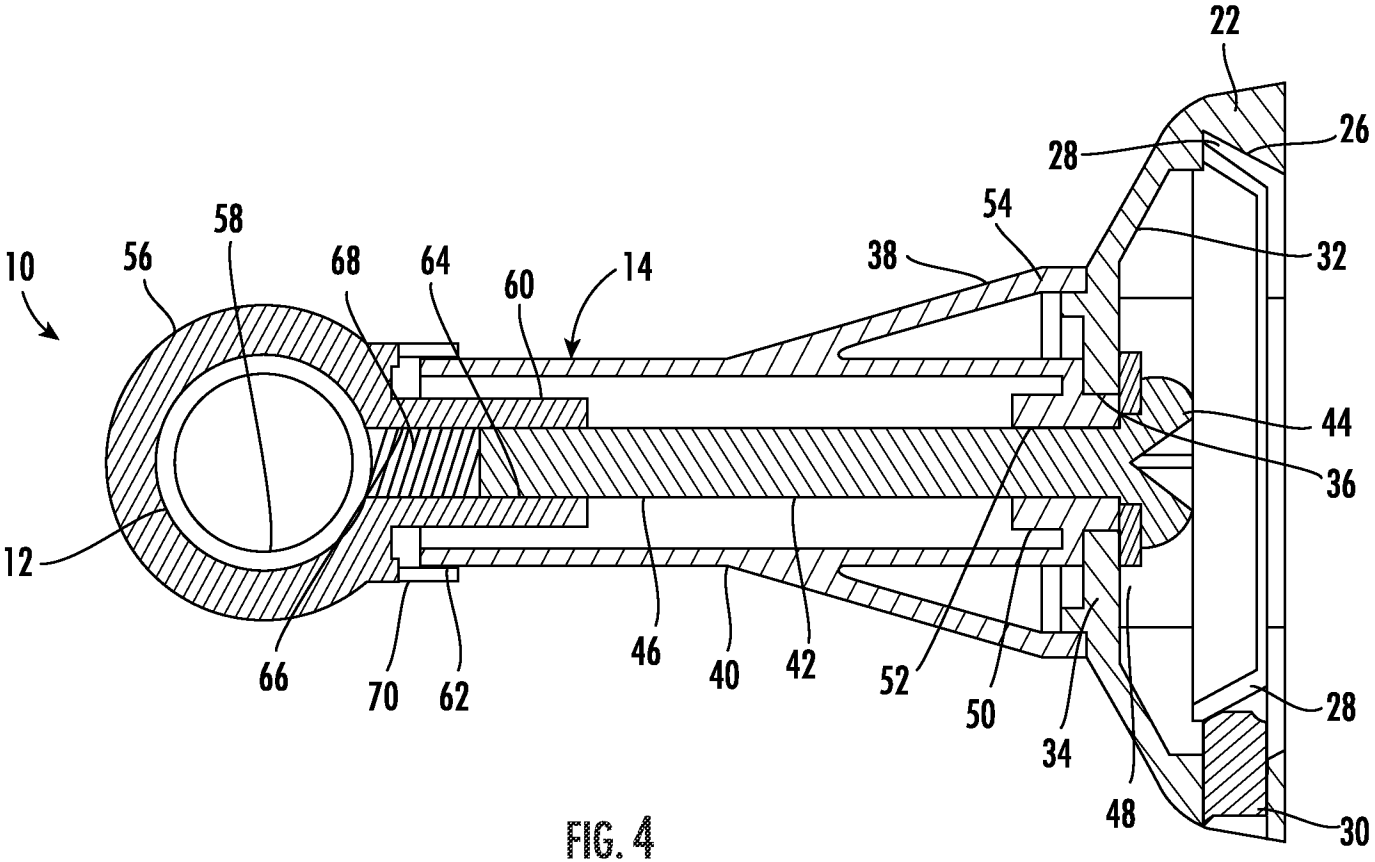
FIG. 4 is a section view of a portion of the towel bar assembly of FIG. 1, taken along section line 4-4.

Each post assembly 14 includes a base or wall collar 22 that attaches directly to the wall mount bracket 16. The wall mount bracket 16 includes an upper inclined surface 24 and a lower inclined surface 26, each of which form an acute angle between the wall mount bracket 16 and the wall 18 facing away from (above and below) the wall mount bracket 16. Referring now to FIG. 4, the collar 22 includes an internal angled contact surface 28 sized to engage the upper inclined surface 26 of the wall mount bracket 16. Referring now to FIGS. 2 and 4, a set screw 30 is installed into each collar 22 to engage the lower inclined surface 28 of the wall mount bracket 16 to fasten and retain the collar 22 upon the wall mount bracket 16 against the wall 18.

Figure 3:
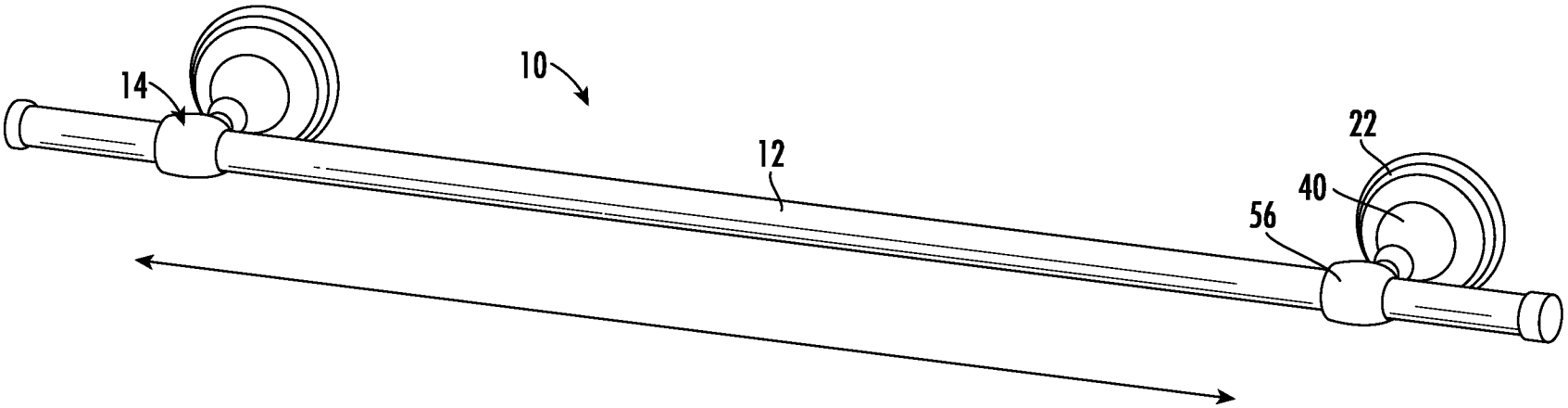
FIG. 3 is a front perspective view of the towel bar assembly of FIG. 1.

Referring now to FIG. 3, once the post assemblies 14 are installed upon the wall 18, the end user can adjust the towel bar 12 laterally relative to the post assemblies 14. FIG. 4 illustrates a cross section of one of the post assemblies 14. The collar 22 includes a cavity 32 to conceal the wall mount bracket 16 as is common in the art. The collar 22 includes a base plate 34 spaced apart from the wall 18. A through aperture 36 is formed through the base plate 34. An annular alignment ring 38 extends from the collar base plate 34 away from the collar 22.

The post assembly 14 includes a post 40 that is formed separately from the collar 22. An externally threaded screw 42 is provided in the post assembly 14. The screw 42 has a screw head 44 disposed in the cavity 32. A threaded screw shaft 46 extends through a washer 48, the through aperture 36 in the base plate 34, and into the post 40. The post 40 includes a boss 50, which extends into the aperture 36 in the base plate 34. The screw shaft 46 extends through an aperture 52 formed through the boss 50. The screw shaft 46 is affixed to the boss 50 so that the screw 42 and the post 40 are fixed to rotate together. The screw shaft 46 is concealed within the post 40.

A proximal end 54 of the post 40 expands in diameter and extends over the alignment ring 38 of the collar 22 for alignment of the post 40 and the collar 22. The enlarged proximal end 54 terminating at the collar 22 provides an ornamental appearance similar to conventional unitary post assemblies.

Each post assembly 14 includes a sleeve 56 with a through aperture 58 to receive the towel bar 12. The through aperture 58 is oversized relative to the towel bar 12 to permit the towel bar 12 to be slid and adjusted relative to the post assemblies 14. A boss 60 extends from the sleeve 56 an into a distal end 62 of the post 40. A threaded aperture 64 is formed in the boss 60 generally perpendicular to the sleeve aperture 58. The screw shaft 46 is in threaded engagement within the threaded aperture 64 of the sleeve boss 60. Manual rotation of the post 40 results in rotation of the screw 42, which consequently adjusts the sleeve 56 relative to the wall collar 22.

The sleeve 56 includes a brake aperture 66 coaxial with the threaded aperture 64 and intersecting with the sleeve aperture 58. A brake 68 is displaced in the brake aperture 66. The brake 68 is formed from a polymeric material, such as a nylon material. The brake 68 is generally cylindrical and abuts the distal end of the screw shaft 46. The brake 68 applies pressure from the screw 42 to the towel bar 12 to lock the towel bar 12 at a selected position.

Figure 5:
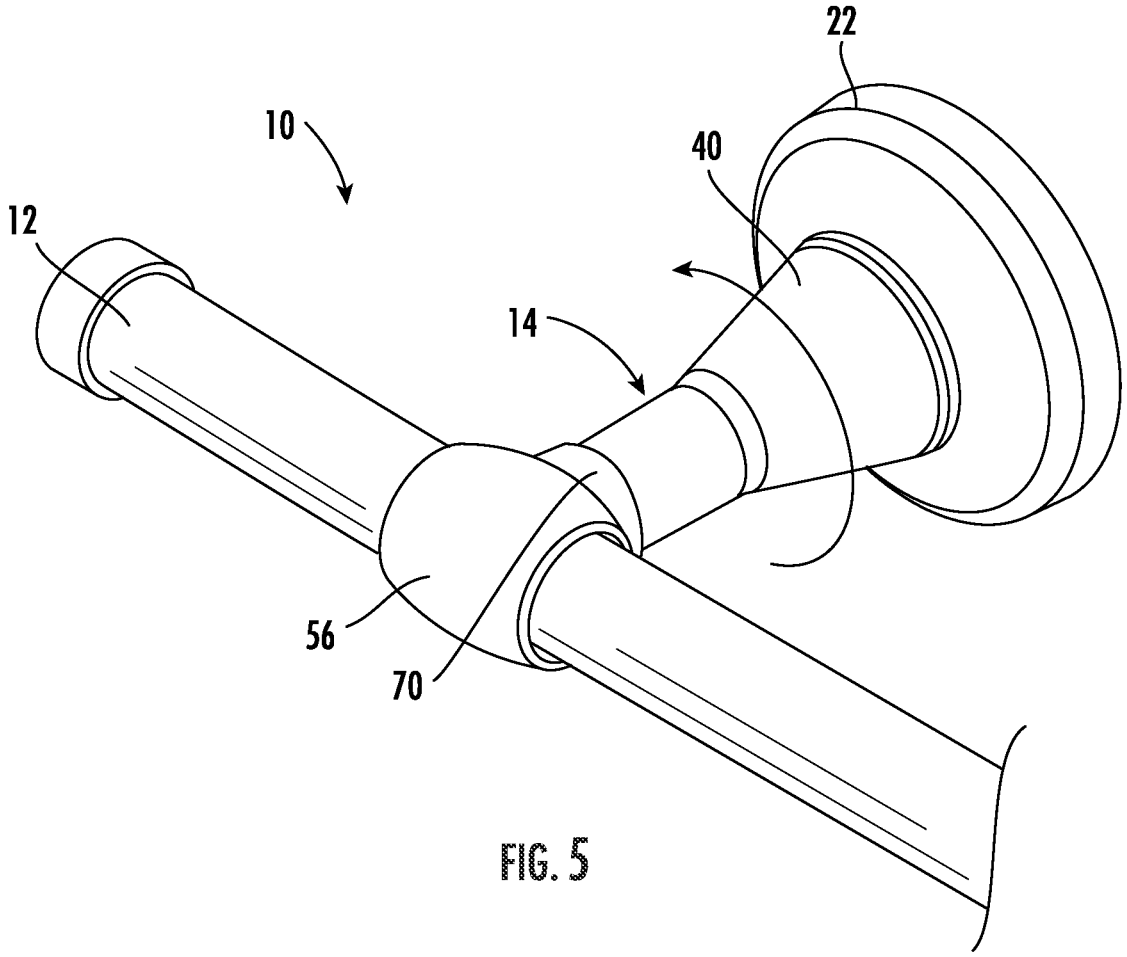
FIG. 5 is a partial front perspective view of a portion of the towel bar assembly of FIG. 1.

Referring now to FIG. 5, once the end user adjusts the towel bar 12 to the selected position, the end user locks the towel bar 12 by rotating the post 40. Rotation of the post 40 counter-clockwise in FIG. 5, consequently rotates the screw 42 (FIG. 4), thereby advancing the sleeve 56 toward the collar 22 and compressing the brake 68 between the towel bar 12 and the screw 42 and locking the towel bar 12 within the sleeve 56.

The sleeve 56 includes a collar 70 extending from the sleeve 56 over the distal end 62 of the posts 40 to conceal the distal end 62 of the post 40 as well as the boss 60 of the sleeve 56. The sleeve collar 70 adds to the appearance of the post assembly 14 matching that of prior art unitary post assemblies.

The towel bar assembly 10 permits adjustable center-to-center mounting of the post assemblies 14 for adjustability, to adapt to various pre-existing mounting patterns, and to permit installation in various locations that may have obstacles or limited mounting space at non-standard spacings.

If the user desires to adjust the towel bar 12 position, the user loosens the posts 40 by rotating the posts 40 clockwise in FIG. 5. Then the user slides the towel bar 12 to another position. The user rotates the posts 40 counter-clockwise to tighten the posts 40 and lock the towel bar 12 in the adjusted position.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A wall mount towel bar assembly comprising:

a wall mount bracket adapted to be mounted to a planar surface;

a threaded shaft supported upon the wall mount bracket for rotation relative to the wall mount bracket;

a sleeve in threaded engagement with the threaded shaft with a sleeve aperture formed through the sleeve; and a bar received for translation through the sleeve aperture, whereby rotation of the threaded shaft in a first rotary direction locks the bar in the sleeve to maintain a position of the bar within the sleeve, and rotation of the threaded shaft in a second rotary direction that is opposite than the first rotary direction unlocks the bar in the sleeve to allow the bar to extend through the sleeve and permit linear adjustment of the bar in a range of positions relative to the sleeve for adjustability of a position of the bar relative to the wall mount bracket, the threaded shaft and the sleeve.

2. The wall mount towel bar assembly of claim 1 further comprising:

fasteners to affix the wall mount bracket to the planar surface; and a collar sized to attach to the wall mount bracket, wherein the threaded shaft is rotatably connected to the collar.

3. The wall mount towel bar assembly of claim 2 further comprising a post connected to the threaded shaft for rotation with the threaded shaft, and sized to enclose the threaded shaft from the collar to the sleeve.

4. The wall mount towel bar assembly of claim 3 wherein the threaded shaft is externally threaded; and wherein the sleeve further comprises a boss extending from the sleeve with a threaded aperture in threaded engagement with the threaded shaft.

5. The wall mount towel bar assembly of claim 4 wherein the sleeve further comprises the collar extending from the sleeve along an axis parallel to the boss to enclose a distal end of the post.

6. The wall mount towel bar assembly of claim 2 wherein a collar through aperture is formed through the collar; and wherein the threaded shaft further comprises a fastener head oriented between a portion of the collar and the wall mount bracket with the threaded shaft extending through the collar through aperture.

7. The wall mount towel bar assembly of claim 6 further comprising a washer oriented about the threaded shaft between the fastener head and the collar.

8. The wall mount towel bar assembly of claim 1 wherein the sleeve further comprises a threaded aperture in cooperation with the threaded shaft and axially intersecting the sleeve aperture.

9. The wall mount towel bar assembly of claim 8 wherein the threaded aperture in the sleeve is perpendicular to the sleeve aperture.

10. The wall mount towel bar assembly of claim 8 wherein a brake aperture is formed in the sleeve axially aligned with the threaded aperture and intersecting the sleeve aperture so that rotation of the threaded aperture applies pressure from the threaded shaft upon the bar.

11. The wall mount towel bar assembly of claim 10 further comprising a brake oriented in the brake aperture to distribute pressure from the threaded shaft to the bar.

12. The wall mount towel bar assembly of claim 11 wherein the brake is formed from a polymeric material.

13. The wall mount towel bar assembly of claim 12 wherein the brake is formed from nylon.

14. The wall mount towel bar assembly of claim 1 further comprising:

a second wall mount bracket adapted to be mounted to the planar surface;

a second threaded shaft supported upon the second wall mount bracket for rotation relative to the second wall mount bracket; and a second sleeve in threaded engagement with the second threaded shaft with an aperture formed therein to receive the bar for translation in the second sleeve, whereby rotation of the second threaded shaft locks the bar in the second sleeve to maintain a position of the bar within the second sleeve.

15. A method of installing a wall mount towel bar assembly comprising the steps of:

providing a wall mount bracket adapted to be mounted to a planar surface;

providing a threaded shaft supported upon the wall mount bracket for rotation relative to the wall mount bracket;

providing a sleeve in threaded engagement with the threaded shaft with a sleeve aperture formed through the sleeve; and providing a bar received for translation through the sleeve aperture, whereby rotation of the threaded shaft in a first rotary direction locks the bar in the sleeve to maintain a position of the bar within the sleeve, and rotation of the threaded shaft in a second rotary direction that is opposite than the first rotary direction unlocks the bar in the sleeve to allow the bar to extend through the sleeve and permit linear adjustment of the bar in a range of positions relative to the sleeve for adjustability of a position of the bar relative to the wall mount bracket, the threaded shaft and the sleeve;

wherein the wall mount bracket is a first wall mount bracket;

wherein the sleeve is a first sleeve;

wherein the threaded shaft is a first threaded shaft;

providing a second wall mount bracket adapted to be mounted to the planar surface;

providing a second threaded shaft supported upon the second wall mount bracket for rotation relative to the second wall mount bracket; and providing a second sleeve in threaded engagement with the second threaded shaft with an aperture formed therein to receive the bar for translation in the second sleeve, whereby rotation of the second threaded shaft locks the bar in the second sleeve to maintain a position of the bar within the second sleeve;

mounting the first wall mount bracket and the second wall mount bracket to a wall;

installing a pair of collars upon the first wall mount bracket and the second wall mount bracket;

translating the bar within the first sleeve and the second sleeve that are supported upon the pair of collars to a selected position;

tightening the first threaded shaft between the first sleeve and a corresponding first collar from the pair of collars; and tightening the second threaded shaft between the second sleeve and a corresponding second collar from the pair of collars to retain the selected position of the bar relative to the first sleeve and the second sleeve.

16. The method of claim 15, further comprising the steps of:

loosening the first threaded shaft and the second threaded shaft;

translating the bar to another selected position; and tightening the first threaded shaft and the second threaded shaft.

17. A method of installing a wall mount towel bar assembly comprising the steps of:

providing a wall mount bracket adapted to be mounted to a planar surface;

providing a threaded shaft supported upon the wall mount bracket for rotation relative to the wall mount bracket;

providing a sleeve in threaded engagement with the threaded shaft with a sleeve aperture formed through the sleeve; and providing a bar received for translation through the sleeve aperture, whereby rotation of the threaded shaft in a first rotary direction locks the bar in the sleeve to maintain a position of the bar within the sleeve, and rotation of the threaded shaft in a second rotary direction that is opposite than the first rotary direction unlocks the bar in the sleeve to allow the bar to extend through the sleeve and permit linear adjustment of the bar in a range of positions relative to the sleeve for adjustability of a position of the bar relative to the wall mount bracket, the threaded shaft and the sleeve;

mounting the wall mount bracket to a wall;

installing a collar upon the wall mount bracket;

translating the bar within the sleeve that is supported upon the collar, to a selected position; and tightening a post between the sleeve and the collar to retain the selected position of the bar relative to the sleeve.

18. The method of claim 17, further comprising the steps of:

loosening the post;

translating the bar to another selected position; and tightening the post.

* * * * *